US005797241A

United States Patent [19]

Schuh et al.

[11] Patent Number: 5,797,241

[45] Date of Patent: Aug. 25, 1998

[54] STATION IN A PACKAGING LINE FOR FOLDING A FLAP OF A BAG

[75] Inventors: Matthias Schuh, Wettenberg; Volker Dersch, Lahntal; Walter Baur, Gruendau, all of Germany

[73] Assignee: Rovema Verpackungsmaschinen GmbH, Fernwald, Germany

[21] Appl. No.: 876,403

[22] Filed: Jun. 16, 1997

[51] Int. Cl.[6] ..... B65B 7/00

[52] U.S. Cl. ..... 53/375.5; 53/375.7; 53/382.2; 53/382.3; 493/151; 493/183

[58] Field of Search ..... 53/375.5, 375.7, 53/375.2, 382.2, 382.3; 493/79, 80, 245, 260, 69, 70, 177, 128, 151, 183

[56] References Cited

U.S. PATENT DOCUMENTS

| | | | |
|---|---|---|---|
| 1,544,315 | 6/1925 | Harrison | 53/375.7 |
| 2,273,585 | 2/1942 | Moore | 53/375.7 |
| 2,533,642 | 12/1950 | Vergobbi | 493/183 |
| 2,571,103 | 10/1951 | Belcher et al. | 53/373.7 |
| 3,097,576 | 7/1963 | Burke | 493/151 |
| 4,569,184 | 2/1986 | Strombeck | 53/382.2 |
| 4,651,501 | 3/1987 | Matsuda et al. | 493/183 |
| 5,324,250 | 6/1994 | Janson et al. | 493/183 |
| 5,613,933 | 3/1997 | Pierce, Jr. et al. | 493/183 |

*Primary Examiner*—James F. Coan
*Assistant Examiner*—Gene L. Kim
*Attorney, Agent, or Firm*—Flynn, Thiel, Boutell & Tanis, P.C.

[57] ABSTRACT

At a station (1) in a packaging line for folding a flap (2) of a bag (3) along a shaping line (10) of the flap (2) and for compressing the folded flap (2) by a folding element (5) against a resistance member (4), the folding element (5) is driven by a drive mechanism (16) into two directions (8, 9). The two directions are perpendicular to one another. A holding element (11) is provided which can be moved against the shaping line (10) and has a rectilinear shaping edge (12). The rectilinear shaping edge (12) guarantees a straight, position-exact shaping line (10). The folding element (5) causes the folding and compressing, and can be returned into a start position for the next flap (2).

14 Claims, 6 Drawing Sheets

STATION IN A PACKAGING LINE FOR FOLDING A FLAP OF A BAG

FIELD OF THE INVENTION

The invention relates to a station in a packaging line for folding a flap of a bag, for example a tubular bag, along a shaping line and for compressing the folded flap with a folding element movable against the flap and against a resistance, and with a feeding device for feeding the bag to the folding element.

BACKGROUND OF THE INVENTION

In order to close a filled, upright positioned bag of a thermoplastic plastic foil, the bag can be heat-sealed at the top by means of welding jaws. The upwardly pointing flap of the bag can be folded downwardly. The height of the flap is, for example, cut in half by the folding. The folded flap can be fixed in its folded position by means of glue, an adhesive strip, or adhesive labels. A folding can also occur with the flap being open and not heat-sealed.

It is known to fold a flap by means of a folding element upon producing a shaping line such that the flap projects relative to a resistance and the projecting, upper part is folded. The folded part of the flap is then pressed against the lower part of the flap by a pressing element.

The known state of the art has the disadvantage that the shaping line because of a clearance of movement for the flap is not always sufficiently straight, which then results in a non-straight upper bag closure.

SUMMARY OF THE INVENTION

The basic purpose of the invention is to provide a station of the above-described type in such a manner that a straight shaping line is created in a reliable manner.

The folding element for folding the flap is driven by a drive mechanism in two directions, which are perpendicular to one another. A holding element is provided, which is movable against the shaping line and has a rectilinear shaping edge.

A straight shaping line is produced in a reliable manner with the inventive station because the flap is first clamped between the resistance member and the holding element, thus it is precisely fixed. After clamping, the upper part of the flap is folded by the folding element at the straight shaping edge, which causes the shaping line to be straight. Lastly, the holding element is removed from the flap, and the folding element presses, because of its movement in one plane, the part of the flap lying above the shaping line against the lower part of the flap and against the resistance member. The two directions of the drive mechanism, which directions are perpendicular to one another, describe the plane of movement of the folding element. The folding element can be moved during the folding operation in this plane away from the resistance member and thereafter again toward the resistance member to first create the shaping line and to then press the flap parts against one another. The clamping and holding of the lower part of the flap and the folding of the upper part of the flap against the rectilinear shaping edge of the holding element provides for the exact creation of the shaping line. The removal of the holding element from the flap and the movement of the folding element against the lower part of the flap and against the resistance member has the purpose of stabilizing the folded flap. The stabilized, folded flap could thereafter be fixed by means of an adhesive label.

If the drive mechanism of the folding element has a cam plate, then a movement cycle of the folding element for folding a flap is performed by a rotation of the cam disk. Only the cam plate must be exchanged for changing in the sequence of movements of the folding element.

The drive mechanism can, however, also move the folding element by means of two motors, which act perpendicular to one another. The motors, for example servomotors, can be operated with the help of a control mechanism. A change in a sequence of movement is achieved by storing other control parameters in the control mechanism.

A drive mechanism has proven to be particularly favorable for a quick and exact flap folding. The drive mechanism describes a path of motion for the folding element, which has a shape generally corresponding to the shape of the number nine. The length of movement is hereby minimized and the folding operation is safely carried out.

If the path of motion is composed of a plurality of straight path sections, then the path of motion can be predetermined in a simplified constructive manner or by programming the control mechanism. Also the active direction of the folding element against the flap is thereby constant at all times for one interval of time.

The generally nine-shaped path of motion is utilized for an optimum flap folding, if the free end of the path of motion describes the step of compressing the folded flap against the resistance member. After the pressing step has ended, the folding element is again removed from the free end along the path of motion from the resistance member in order to move into a start position for a new flap folding operation along the closed part of the nine-shaped movement.

The use of construction material is minimized if the folding element is rigidly connected to a carriage, a cam roller is rotatably fastened on the carriage, and the cam roller rolls along the outer curved surface of the cam plate. The movement of the carriage corresponds with the movement of the folding element. The carriage can be moved by a cam roller spaced farther from the folding element. The transfer of movement is hereby very reliable.

If the cam plate is connected rotatably to a mounting movable by means of orthogonal linear guides, this mounting can always be moved such that the cam plate maintains contact with the cam roller.

The purpose of a secure bearing of the cam roller on the cam disk is also served by a tension spring positioned between the mounting and the carriage. The tension spring provides a minimum pressure with which the cam roller acts against the cam plate. If the tension spring is provided in the area of the cam roller, the pressure production is more independent of possible tilting movements and torque between the cam roller and cam plate.

A crank drive is suited as a simple and reliable drive for the cam plate. If a connecting rod of the crank drive connects the cam plate to the movable mounting, the cam plate can then be driven independent of the position of the mounting by the crank drive. Thereby, the cam roller is at all times in contact with the cam plate.

A pivotable holding element can be simply moved toward the flap and can be removed from the same. If the holding element acts against the flap at half of the height of the flap, the flap is then also bent at half of the height of the flap and the bent flap has a minimum height.

BRIEF DESCRIPTION OF DRAWINGS

The invention will be described in greater detail hereinafter in connection with the figures illustrating one exemplary embodiment, in which figures.

DETAILED DESCRIPTION

Figure 1:
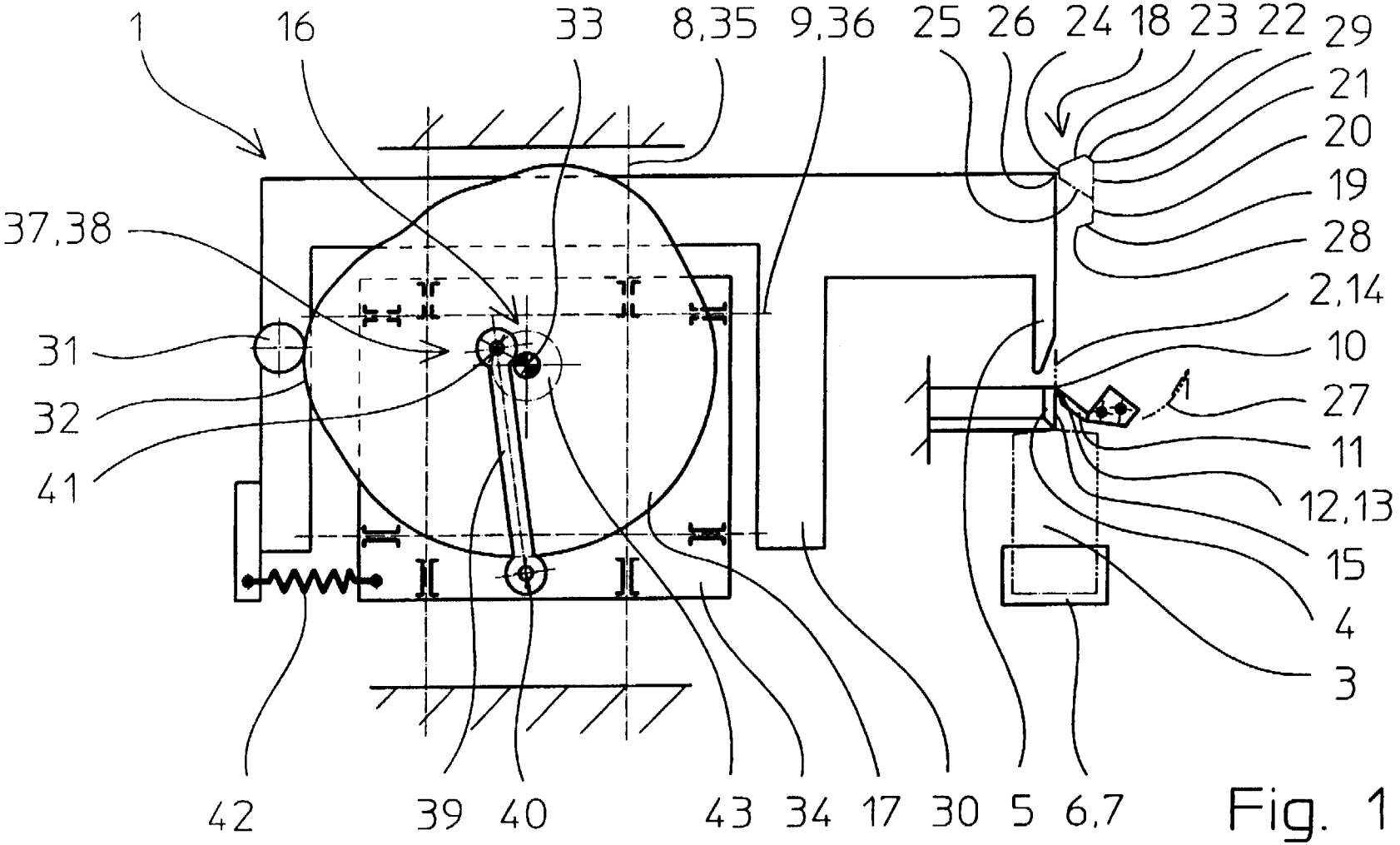
FIG. 1 is a side view of a station of a packaging line, whereby a bag with an upright positioned flap has arrived at the station, with a holding element pressing against the flap and a resistance member at half of the height of the flap, and a folding element for folding the flap, which is rigidly connected to a carriage, which has a cam roller rolling along a cam plate.

Flaps 2 of bags 3 are folded and compressed at a station 1 in a packaging line (FIG. 1). A flap 2, which has first been sprayed on one side with a hot glue, is halved with respect to its remaining height and is reinforced due to the then created two-ply flap position. The bags 3 reach the station 1 in a fixed operational cycle.

A folding element 5 movable against the flap 2 and against a resistance member 4 is provided at the station 1. A feeding device 6 in the form of a slotted belt 7 guides per cycle time one new bag 3 to the station 1 in such a manner that the flap 2 of the bag 3 rests on the resistance member 4.

Figure 2:
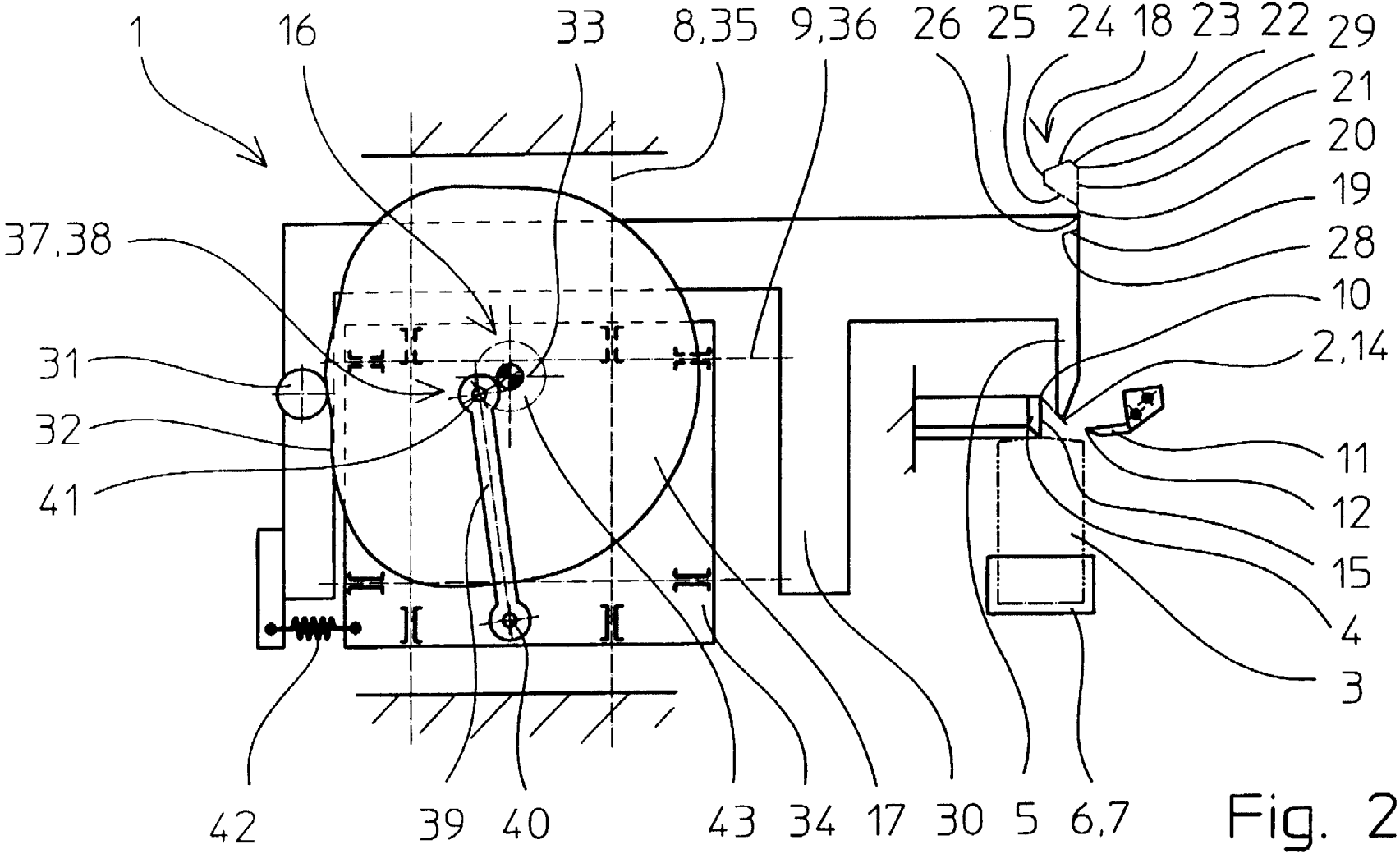
FIG. 2 is a side view of the subject matter of FIG. 1, however at a later time, with the holding element having been swung away and the upper part of the flap having been folded by the folding element, and with a downwardly moved mounting, on which the cam plate is rotatably fastened.
Figure 3:
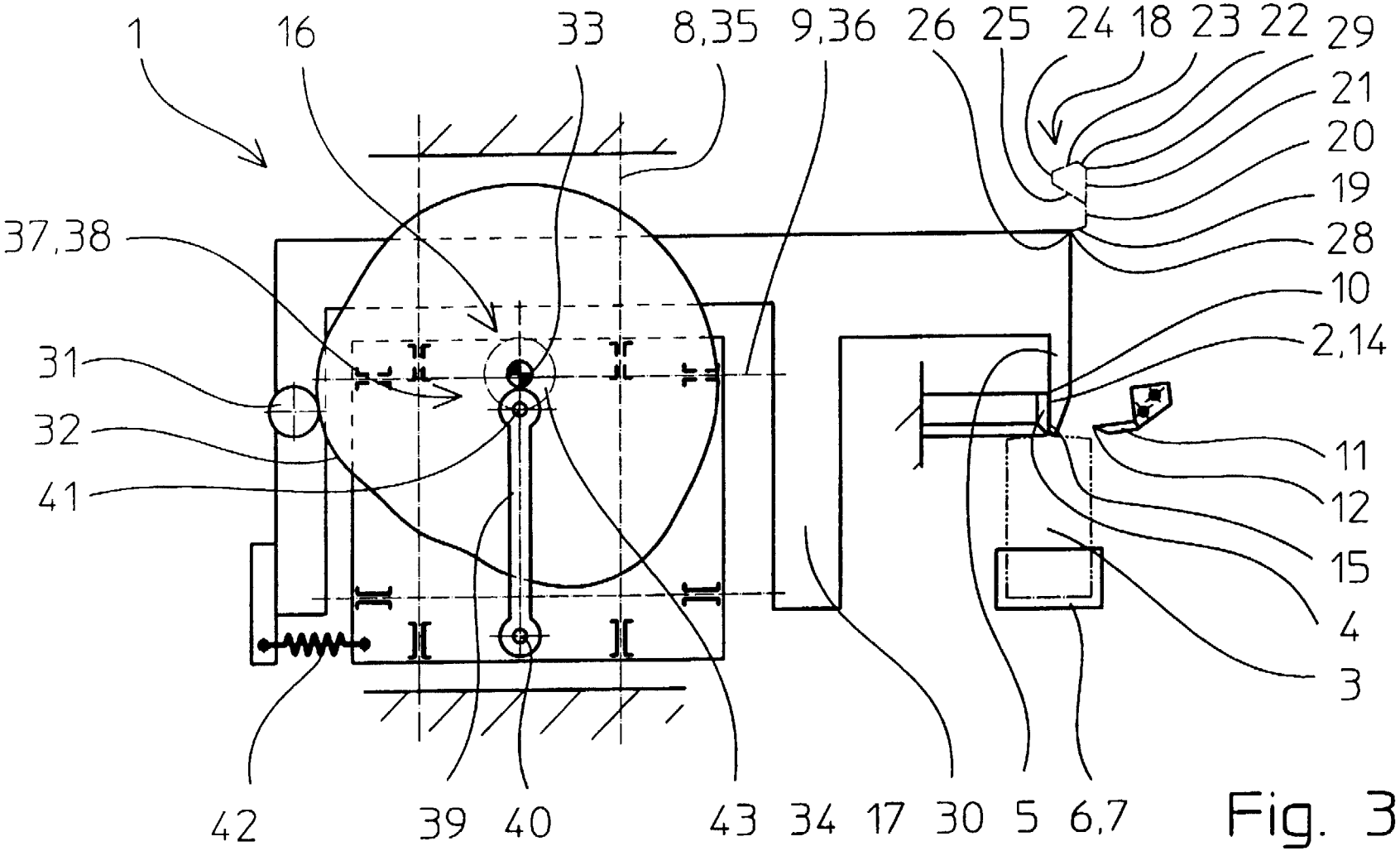
FIG. 3 is a side view of the subject matter of FIG. 2, however at a later time, with a flap, which has been folded and has been pressed by the folding element against the resistance member.

The folding element 5 is driven by a drive mechanism 16 in two directions 8, 9, which directions are perpendicular to one another. A holding element 11 can be moved against a shaping line 10 of the flap 2. The holding element 11 has a rectilinear shaping edge 12. The flap 2 is creased by the rectilinear shaping edge 12. The holding element 11 is first pressed against the shaping line 10 and against the resistance member 4. The shaping edge 12 acts thereby at half of the height 13 of the flap 2 against itself. The folding element 5 folds subsequently along the shaping line 10 initially with the holding element 11 holding the flap 2 unchanged. While the upper part 14 of the flap 2 is swung against the lower part 15 of the flap 2, the holding element 11 is swung away from the flap 2 (FIG. 2) so that the folding element 5 can press the upper part 14 against the lower part 15. The parts 14, 15 are thereby adhesively secured together, for example by a glue (FIG. 3).

The folding element 5 is thereafter returned into its initial position (FIGS. 4 to 6), and a new bag is finally fed to the station 1.

Figure 4:
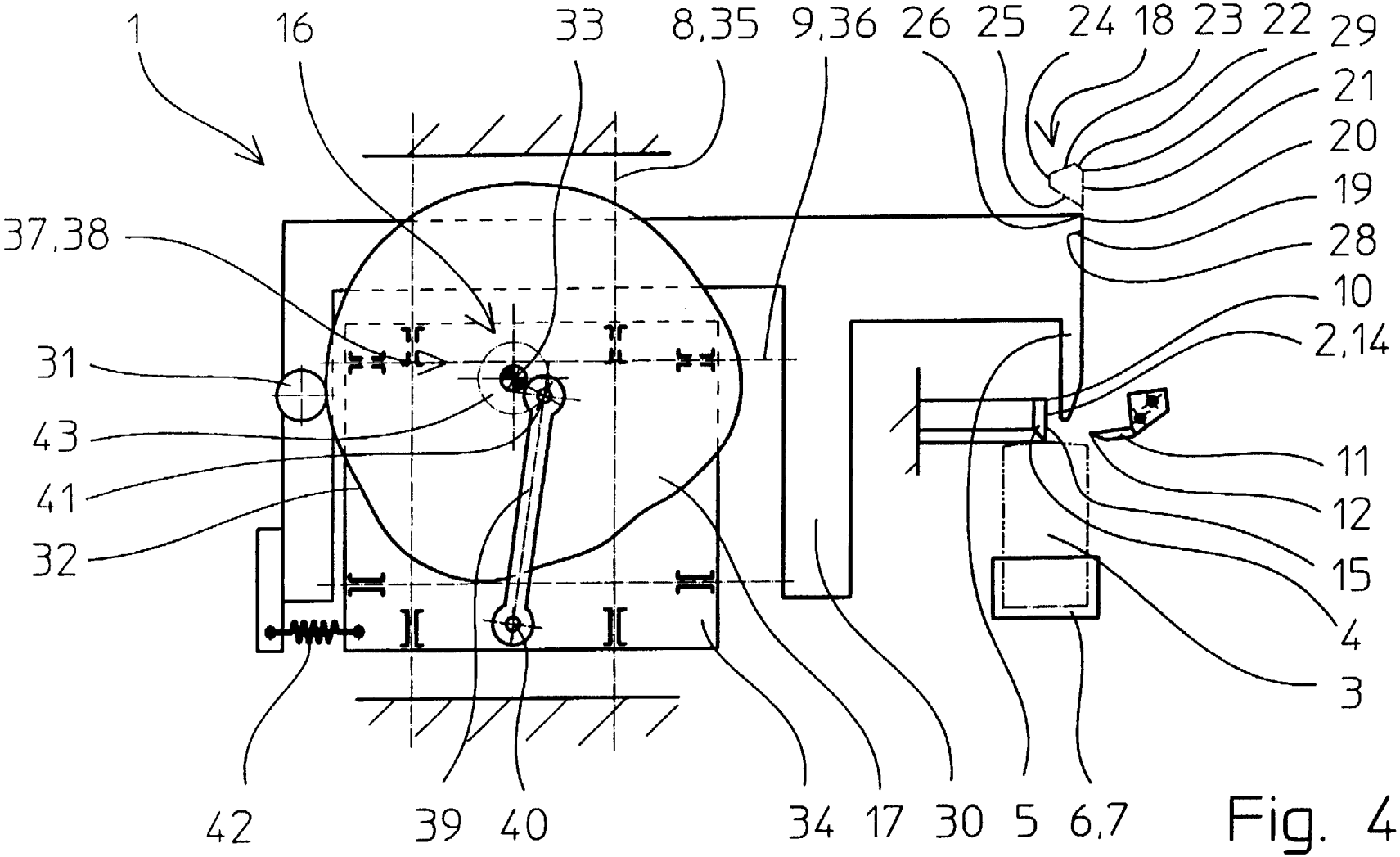
FIG. 4 is a side view of the subject matter of FIG. 3, however at a later time, with the folding element having been removed from the flap.
Figure 5:
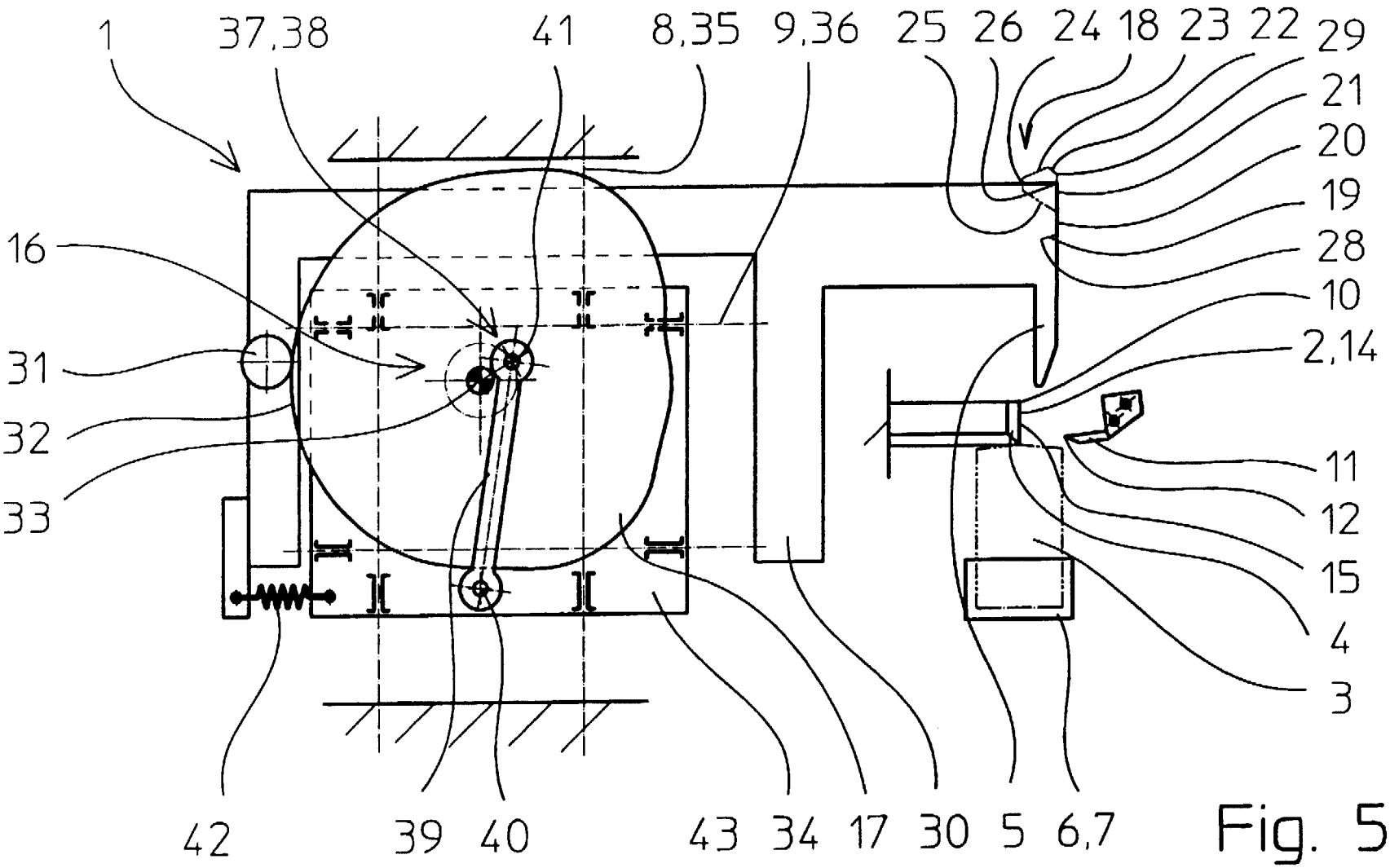
FIG. 5 a side view of the subject matter of FIG. 4, however at a later time, with the folding element being removed farther from the flap.
Figure 6:
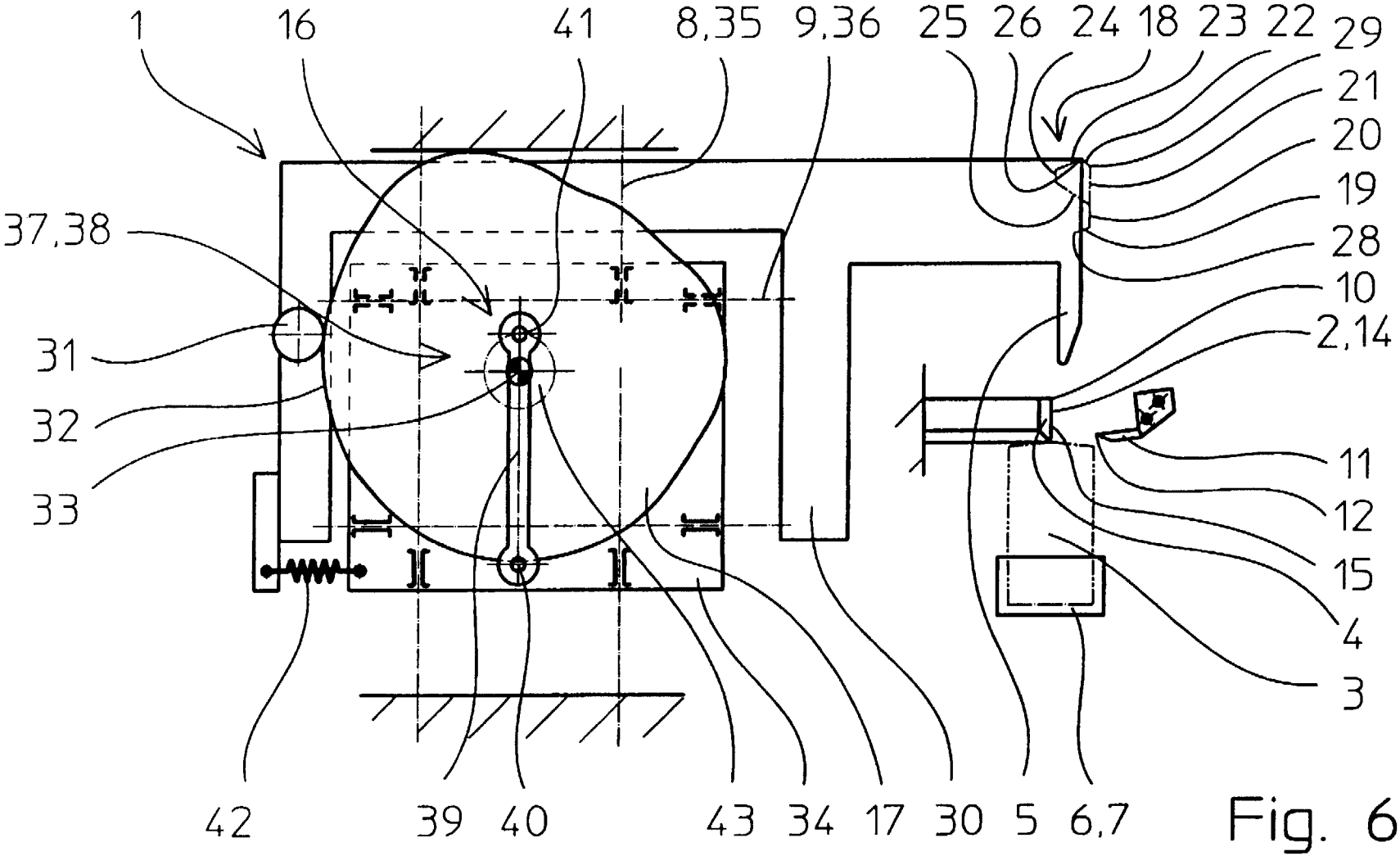
FIG. 6 is a side view of the subject matter of FIG. 5, however at a later time and at a further position of the folding element.

The drive mechanism 16 of the station 1 houses a cam plate 17. The cam plate 17 is designed such that it directs through the entire drive mechanism 16, which has a motor 43, the folding element 5 in a generally number nine-shaped path of motion 18. The path of motion 18 is composed of a plurality of straight path sections 19, 20, 21, 22, 23, 24, 25. From the position of the folding element 5 of FIG. 1, the path section 25 represents a reference point 26 at which the path of the folding element is started. The path section 20 is accordingly illustrated in FIG. 2. FIG. 3 illustrates the end of the path section 19. FIG. 4 illustrates the next end after a reversed moving through the path section 19 and a portion of the path section 20. FIGS. 4 to 6 illustrate movement through the path sections 21 and 22.

The holding element 11 describes a curved path 27 corresponding with its swinging motion.

Whereas the free end 28 of the generally nine-shaped path of motion 18 describes the operation of compressing the folded flap 2 against the resistance member 4, the closed portion 29 of the generally nine-shaped path of movement 28 presses the return of the folding element 5 into a start position for a new folding operation for a following flap 2 on the next bag.

The folding element 5 is rigidly connected to a carriage 30. In addition, a cam roller 31 is rotatably connected onto the carriage 30. The cam roller 31 rolls along the curve 32 of the cam plate 17. The cam plate 17 is connected, rotatably through its axis of rotation 33, to a movable mounting 34. The mounting 34 can be moved in a plane along linear guides 35, 36, which are perpendicular to one another, in directions 8, 9 or rather a combination of directions 8, 9.

A crank drive 38 is provided as the drive means 37 for the cam plate 17. A connecting rod 39 of the crank drive 38 is connected through a joint 40 to the movable mounting 34 and through a further joint 41 to the cam plate 17.

A tension spring 42 is provided between the movable mounting 34 and the carriage 30, in the area of the cam roller 31. The tension spring 42 causes a good firm contact between the cam roller 31 and the curve 32 of the cam plate 17.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A station in a packaging line for folding a flap of a bag along a shaping line of the flap and for compressing the folded flap, comprising: a resistance member against which a flap is pressed; a folding element movable against the flap and against the resistance member; a feeding device for feeding a bag to said folding element; a drive mechanism for driving the folding element in two perpendicular directions, said drive mechanism having a movable mounting and a cam plate for controlling the movement of said folding element, said cam plate rotating about an axis of rotation and being mounted to said movable mounting at the axis of rotation, said movable mounting having linear guides for providing linear movement of said movable mounting, said linear guides being positioned at right angles to each other providing movement in two planar, perpendicular directions; and a holding element being movable against a shaping line of the flap and having a rectilinear shaping edge.

2. The station according to claim 1, wherein said drive mechanism moves said folding element by means of two motors, said two motors move said folding element respectively in two directions perpendicular to one another.

3. The station according to claim 1, wherein said drive mechanism moves said folding element in a path of motion having a shape generally corresponding to the number nine.

4. The station according to claim 3, wherein said path of motion is composed of a plurality of straight path sections.

5. The station according to claim 3, wherein a free end of said generally nine-shaped path of motion defines an operation of compressing said folded flap against said resistance member.

6. The station according to claim 1, wherein said folding element is rigidly connected to a carriage, a cam roller is rotatably connected to said carriage, and said cam roller rolls along a curve of said cam plate.

7. The station according to claim 1, wherein a crank drive is provided as the drive mechanism for said cam plate.

8. The station according to claim 7, wherein a connecting rod of said crank drive is connected to said movable mounting through a joint and to said cam plate through a further joint.

9. The station according to claim 6, wherein a tension spring is provided between said movable mounting and said carriage.

10. The station according to claim 9, wherein said tension spring is provided in the area of said cam roller.

11. The station according to claim 1, wherein said holding element is pivotal.

12. The station according to claim 1, wherein said holding element acts against said flap at half of the height of said flap.

13. The station according to claim 1, wherein a crank drive is provided as the drive mechanism for said cam plate.

14. A folding station in a packaging apparatus, comprising: means for folding a flap of a package to close the package, said means for folding being moveable in two perpendicular directions; and a drive means for controlling said means for folding, said drive means having a mounting frame and a cam rotatably fixed onto said mounting frame, said cam moving said means for folding along a path of movement to fold a flap of a package, said mounting frame having linear guides mounted perpendicular to each other for allowing said mounting frame and cam to move in two perpendicular directions.

* * * * *